US010184247B2

(12) United States Patent
Kassnel-Henneberg

(10) Patent No.: US 10,184,247 B2
(45) Date of Patent: Jan. 22, 2019

(54) INSULATING GLASS WITH LOAD-BEARING PROPERTIES

(71) Applicant: Glas Trösch Holding AG, Buochs (CH)

(72) Inventor: Bruno Kassnel-Henneberg, Diedorf (DE)

(73) Assignee: GLAS TRÖSCH HOLDING AG, Buochs (NL)

( * ) Notice: Subject to any disclaimer, the term of this patent is extended or adjusted under 35 U.S.C. 154(b) by 0 days.

(21) Appl. No.: 15/009,236

(22) Filed: Jan. 28, 2016

(65) Prior Publication Data

US 2016/0222652 A1 Aug. 4, 2016

(30) Foreign Application Priority Data

Jan. 29, 2015 (CH) ..... 0104/15

(51) Int. Cl.

| | |
|---|---|
| ***E04B 2/92*** | (2006.01) |
| ***E06B 3/02*** | (2006.01) |
| ***E06B 3/66*** | (2006.01) |
| ***E06B 3/663*** | (2006.01) |
| ***E06B 3/673*** | (2006.01) |
| ***E06B 3/54*** | (2006.01) |
| ***E06B 3/56*** | (2006.01) |
| ***E06B 3/64*** | (2006.01) |

(52) U.S. Cl.

CPC ..... *E04B 2/92* (2013.01); *E06B 3/025* (2013.01); *E06B 3/5409* (2013.01); *E06B 3/56* (2013.01); *E06B 3/645* (2013.01); *E06B 3/6612* (2013.01); *E06B 3/6621* (2013.01); *E06B 3/6625* (2013.01); *E06B 3/66366* (2013.01); *E06B 3/67343* (2013.01)

(58) Field of Classification Search

CPC ..... E04B 2/92; E06B 3/025; E06B 3/5409; E06B 3/56; E06B 3/645; E06B 3/6612; E06B 3/6621; E06B 3/6625; E06B 3/66366; E06B 3/67343

See application file for complete search history.

(56) References Cited

U.S. PATENT DOCUMENTS 3,653,156 A * 4/1972 Horgan, Jr. ..... E06B 3/02 49/501
3,759,771 A * 9/1973 Battersby ..... E06B 3/66342 118/408

(Continued)

FOREIGN PATENT DOCUMENTS

EP 2594721 A2 5/2013
WO WO 2010/088904 A1 8/2010

*Primary Examiner* — James M Ference

(74) *Attorney, Agent, or Firm* — Birch, Stewart, Kolasch & Birch, LLP

(57) ABSTRACT

The present application relates to an insulating glass (1) having at least two glass panes (2, 3) spaced apart from one another. The insulating glass (1) comprises at least one marginal join arranged between the glass panes (2, 3) in the region (8, 9, 10, 11) of edges (4, 5, 6, 7) of said glass panes (2, 3), said marginal join consisting of a spacer (12) and also at least one adhesive. The marginal join comprises a first adhesive at least in the region (8, 9) of two mutually opposite edges (4, 5), said adhesive having a rigidity in the cured state of at least 50 N/mm$^2$, preferably of at least 100 N/mm$^2$.

11 Claims, 3 Drawing Sheets

(56) References Cited

U.S. PATENT DOCUMENTS 3,875,706 A * 4/1975 Okawa ..... E06B 3/64 181/289
3,971,178 A * 7/1976 Mazzoni ..... E06B 3/5418 52/172
4,316,967 A * 2/1982 Hergenrother ..... C08C 19/44 521/134
4,335,166 A * 6/1982 Lizardo ..... E06B 3/6715 156/107
4,519,962 A * 5/1985 Schlienkamp ..... E06B 3/67365 118/323
4,662,135 A * 5/1987 Tanikawa ..... E04B 2/92 52/235
4,950,344 A * 8/1990 Glover ..... E06B 3/66342 156/104
4,994,315 A * 2/1991 Schreiber ..... E06B 3/56 296/84.1
5,007,217 A * 4/1991 Glover ..... E06B 3/66328 428/34
5,115,346 A * 5/1992 Lynam ..... B32B 17/10064 359/265
5,185,979 A * 2/1993 Azzimonti ..... E04B 2/967 52/235
5,234,730 A * 8/1993 Lautenschlaeger ..... B32B 7/14 156/109
5,239,406 A * 8/1993 Lynam ..... B32B 17/10 296/215
5,355,245 A * 10/1994 Lynam ..... B32B 17/10 359/267
5,533,314 A * 7/1996 Kunert ..... B32B 3/10 156/109
5,544,465 A * 8/1996 Hood ..... E04C 2/54 52/786.11
5,618,904 A * 4/1997 Martin ..... C08G 18/3215 528/73
5,655,282 A * 8/1997 Hodek ..... E06B 3/66309 156/107
5,851,609 A * 12/1998 Baratuci ..... B29C 47/0019 428/34
6,002,521 A * 12/1999 Town ..... E06B 3/6604 359/1
6,399,169 B1 * 6/2002 Wang ..... E06B 3/6612 428/34
7,309,732 B1 * 12/2007 Issari ..... C08F 2/48 522/71
8,397,450 B1 * 3/2013 Neal ..... E06B 1/6023 52/204.1
2001/0001357 A1 * 5/2001 Reichert ..... E06B 3/66319 52/786.13
2002/0033000 A1 * 3/2002 Pantelides ..... E04B 1/043 52/745.05
2002/0189743 A1 * 12/2002 Hornung ..... E06B 3/24 156/109
2003/0024183 A1 * 2/2003 Burnside ..... B60J 1/006 52/208
2004/0074147 A1 * 4/2004 Jasperson ..... E06B 3/6604 49/204
2005/0118401 A1 * 6/2005 Smith ..... B32B 17/10018 428/201
2005/0132662 A1 * 6/2005 Hornung ..... E06B 3/24 52/202
2005/0236868 A1 * 10/2005 Beekman ..... B60J 1/1861 296/190.1
2006/0099356 A1 * 5/2006 Pray ..... B32B 17/10247 428/32.34
2006/0154005 A1 * 7/2006 Misonou ..... C03C 27/10 428/34
2006/0260229 A1 * 11/2006 McKinlay ..... E06B 3/22 52/204.593
2006/0287408 A1 * 12/2006 Baikerikar ..... C03C 17/007 522/71
2007/0056231 A1 * 3/2007 DiMario ..... B60J 1/00 52/204.53
2007/0125490 A1 * 6/2007 Elwakil ..... B32B 17/10036 156/277
2007/0151178 A1 * 7/2007 Baikerikar ..... C03C 17/007 52/204.5
2007/0172636 A1 * 7/2007 Smith ..... B32B 17/10018 428/195.1
2007/0172637 A1 * 7/2007 Hayes ..... B32B 17/10 428/220
2007/0196629 A1 * 8/2007 Smith ..... B32B 17/10 428/195.1
2007/0196630 A1 * 8/2007 Hayes ..... B32B 17/10 428/195.1
2008/0206504 A1 * 8/2008 Hayes ..... B32B 17/10 428/38
2008/0233279 A1 * 9/2008 Smith ..... B32B 17/10 427/145
2008/0233352 A1 * 9/2008 Smith ..... B32B 17/10 428/152
2008/0233371 A1 * 9/2008 Hayes ..... B32B 17/10036 428/210
2008/0233377 A1 * 9/2008 Smith ..... B32B 17/10036 428/220
2008/0233412 A1 * 9/2008 Smith ..... B32B 17/10 428/461
2008/0264558 A1 * 10/2008 Hayes ..... B32B 17/10 156/277
2008/0268214 A1 * 10/2008 Hayes ..... B32B 17/10 428/210
2008/0280076 A1 * 11/2008 Hayes ..... B32B 17/10 428/29
2008/0286542 A1 * 11/2008 Hayes ..... B32B 17/10 428/213
2008/0311332 A1 * 12/2008 Sakurai ..... C09J 151/00 428/41.3
2009/0056246 A1 * 3/2009 Prince ..... E06B 3/56 52/204.53
2009/0064608 A1 * 3/2009 Milburn ..... E06B 3/6621 52/204.62
2009/0301637 A1 * 12/2009 Reichert ..... E06B 3/66314 156/109
2010/0011703 A1 * 1/2010 Seele ..... E06B 3/663 52/786.1
2010/0098888 A1 * 4/2010 Landon ..... C03C 27/10 428/34
2010/0139193 A1 * 6/2010 Goldberg ..... B32B 7/12 52/309.3
2010/0139195 A1 * 6/2010 Tinianov ..... E06B 3/66333 52/309.13
2012/0137607 A1 * 6/2012 Kristensen ..... E04D 13/0354 52/204.62
2013/0212957 A1 * 8/2013 Cempulik ..... E06B 3/66319 52/172
2014/0290156 A1 * 10/2014 Bruce ..... E06B 3/677 52/171.3
2015/0093539 A1 * 4/2015 Krugmann ..... B32B 17/10293 428/99
2016/0222652 A1 * 8/2016 Kassnel-Henneberg ..... E04B 2/92

* cited by examiner

INSULATING GLASS WITH LOAD-BEARING PROPERTIES

TECHNICAL FIELD

The invention relates to an insulating glass which can be used, in particular in façade construction, as a load-bearing structure.

PRIOR ART

A multiple-pane insulating glass is a component for windows which comprises at least two glass panes. A pane intermediate space is located between the glass panes and is filled with air or a gas, in particular a noble gas. In order to mechanically hold the glass panes together at a distance, spacers are used.

Known spacers are, for example, profiles made of aluminum, high-grade steel or plastic, which are connected to the glass panes on both sides by means of a layer of a sealant, in particular polyisobutylene. The sealant additionally acts as an adhesive, which adhesively bonds the glass panes to the spacer. The intermediate space between the edge of the glass panes and the spacer is usually filled with a polymer, for example a polyurethane, in order to achieve further sealing and adhesive bonding of the glass panes.

In order that an insulating glass has adequate stability for resisting loads, which arise, for example, through wind, use is presently made of a frame made of plastic, aluminum or wood, this frame framing the circumference of the insulating glass. The insulating glass is reinforced by the frame. If the insulating glass is moreover intended to perform a load-bearing function, for example in façade construction, in which for example the insulating glass is used without being supported by a frame system, this is only possible to a limited extent. In such a case, the glass panes have to have a correspondingly rigid form in order to be able to resist the loads.

SUMMARY OF THE INVENTION

It is an object of the invention to provide an insulating glass appropriate to the technical field mentioned in the introduction in which it is possible to dispense with a frame system and which can be used in façade construction as a load-bearing structure.

The achievement of the object is defined by the features of claim 1. According to the invention, the insulating glass comprises at least two glass panes spaced apart from one another. A marginal join is arranged between the glass panes at least in the region of edges of said glass panes. The marginal join consists of a spacer and also at least one adhesive, wherein the marginal join comprises a first adhesive at least in the region of two mutually opposite edges, said adhesive having a rigidity in the cured state of at least 50 N/mm$^2$, preferably of at least 100 N/mm$^2$.

The use of an adhesive having such a high rigidity over a loading duration which is typical in the case of a wind load which, pursuant to the standard SIA 261 of 2014, arises with an effective duration of 3 to 10 seconds produces a relatively rigid insulating glass having a high resistance. It is therefore possible for an insulating glass of this type to perform a load-bearing function, in particular in façade construction, it being necessary for the insulating glass pane to be supported only at the two edges in the region of which the first adhesive is arranged. The two other edges in this case do not have to be supported by a conventional façade substructure (pillar).

In this case, it is possible to dispense with a frame structure entirely, or it is possible for said frame structure to be reduced to minimal dimensions.

Spacers are known from the prior art. They can be manufactured from any desired material, such as for example aluminum. In the case of the insulating glass according to the invention, a spacer made of a polymer is preferably used, as a result of which the thermal conductivity can be reduced, this having a positive effect on the thermal insulation of an insulating glass according to the invention. The spacer can be configured as a hollow profile or as a solid profile.

The adhesive preferably has constant mechanical properties, in particular said rigidity in a temperature range of at least −20° C. to at least +80° C. As a result, the structural dimensions of the insulating glass do not vary too greatly depending on the temperature. This provides an efficient applicability of the insulating glass with respect to wind loads and also climatic loads in a wide temperature range.

A sealant, in particular polyisobutyl, is preferably arranged between a respective glass pane and the spacer, as is known from the prior art.

The distance between the at least two glass panes is preferably between 8 mm and 20 mm. The first adhesive preferably fills the intermediate space between the at least two glass panes completely in terms of height, that is to say that the thickness of the first adhesive corresponds to the distance between the at least two glass panes.

The first adhesive preferably has a short-term stability with respect to erosion by wind loads of at least 5 N/mm$^2$, preferably of at least 10 N/mm$^2$. Short-term stability is understood to mean the resistance of the adhesive which the latter has during wind loading of between 3 seconds and 10 seconds.

The first adhesive is preferably applied in the region of the at least two mutually opposite edges to a width of 20 mm to 200 mm, in particular of 20 mm to 120 mm, from the edge in the direction of the center of the glass panes.

The variation in the width of the first adhesive in this region makes it possible to optimally adapt the rigidity and the resistance of the insulating glass according to the expected loading, while simultaneously using thin glass panes. It is thereby possible to save material, and this reduces the production costs for an insulating glass pane according to the invention.

Depending on the mechanical demands on the insulating glass, the width of the first adhesive applied can be adapted. The mechanical demands are determined in particular by the climatic conditions and also the expected maximum wind loads at the site at which the insulating glass is used.

It is preferable that the at least two glass panes are rectangular, the longer of the four edges having a length of at least 2 meters. The solution according to the invention also makes it possible to produce large insulating glasses, since these have a high stability by virtue of the relatively high strength compared to insulating glasses according to the prior art.

The marginal join preferably comprises the first adhesive in the region of those opposing edges in which the insulating glass is supported during the intended use thereof. By virtue of this arrangement of the first adhesive in these regions, it is possible to achieve targeted stiffening of the marginal join in the region of those edges which are exposed to the greatest loading.

The marginal join preferably comprises at least one second adhesive in the region of the further edges of the glass panes, the second adhesive having a lower rigidity than the first adhesive.

The use of an adhesive having a lower rigidity makes it possible to reduce the loading on the marginal join, in particular as a result of climatic loading, along the edges at which the insulating glass is not supported.

The at least one second adhesive is preferably applied to a smaller width in the region of the further edges than the first adhesive in the region of the two opposing edges.

Particularly if the first adhesive is applied in the region of those edges which are exposed to the greatest loading, the width of the applied adhesive can be reduced in the region of the further edges. It is thereby possible both to save material costs and also to improve the visual appearance of the insulating glass pane.

It is preferable that the width of the adhesive in the region of each edge is adapted according to the expected forces, which are to be expected on account of the planned site of use, the prevailing climatic conditions and also the size of the insulating glass pane.

At least one respective anchoring element is preferably inserted in the first adhesive in the region of the at least two mutually opposite edges.

It is thereby possible for the insulating glass according to the invention to be connected to further structures, such as for example steel girders. Since the first adhesive has a high tensile strength, it is possible with the insulating glass according to the invention to fasten anchoring elements directly and without the aid of further components on the insulating glass itself.

A film consisting of a polymer is preferably stretched between the at least two glass panes and parallel thereto, the film being spaced apart from the glass panes in each case by way of at least one spacer.

In this way, an additional thermal insulation layer can be introduced into the insulating glass without the insulating glass experiencing a significant increase in weight—as would be the case if a further glass pane were to be arranged in the insulating glass. In this case, the film is spaced apart from the glass panes in each case via a spacer.

It is preferable that the outermost glass panes of the at least two glass panes consist of a glass laminate. It is thereby possible for the resistance of the insulating glass to be additionally increased.

It is a further object of the invention to provide a method for producing an insulating glass, in particular an insulating glass according to the above description. The method according to the invention comprises, as the first step, the provision of a first glass pane, and in a second step at least one spacer is arranged circumferentially in the region of the edges of the first glass pane at a distance. This is followed by the application of a first adhesive, which has a rigidity in the cured state of at least 50 N/mm$^2$, between at least two mutually opposite edges of the first glass pane and the associated spacer. A second glass pane is positioned on the at least one spacer before or after the application of the first adhesive.

Depending on the desired number of glass panes in the insulating glass, it is possible to arrange further layers consisting of a marginal join comprising a spacer and first adhesive and also a glass pane on the insulating glass. It is thereby possible, for example, to also produce a triple insulating glass, in addition to the described double insulating glass, with the method according to the invention.

The two mutually opposite edges are preferably those edges at which the insulating glass is supported during intended use.

Further advantageous embodiments and combinations of features of the invention arise from the following detailed description and the entirety of the patent claims.

BRIEF DESCRIPTION OF THE DRAWINGS

The drawings used to explain the exemplary embodiment show.

In principle, identical parts are denoted by identical reference signs in the figures.

WAYS OF CARRYING OUT THE INVENTION

Figure 1:
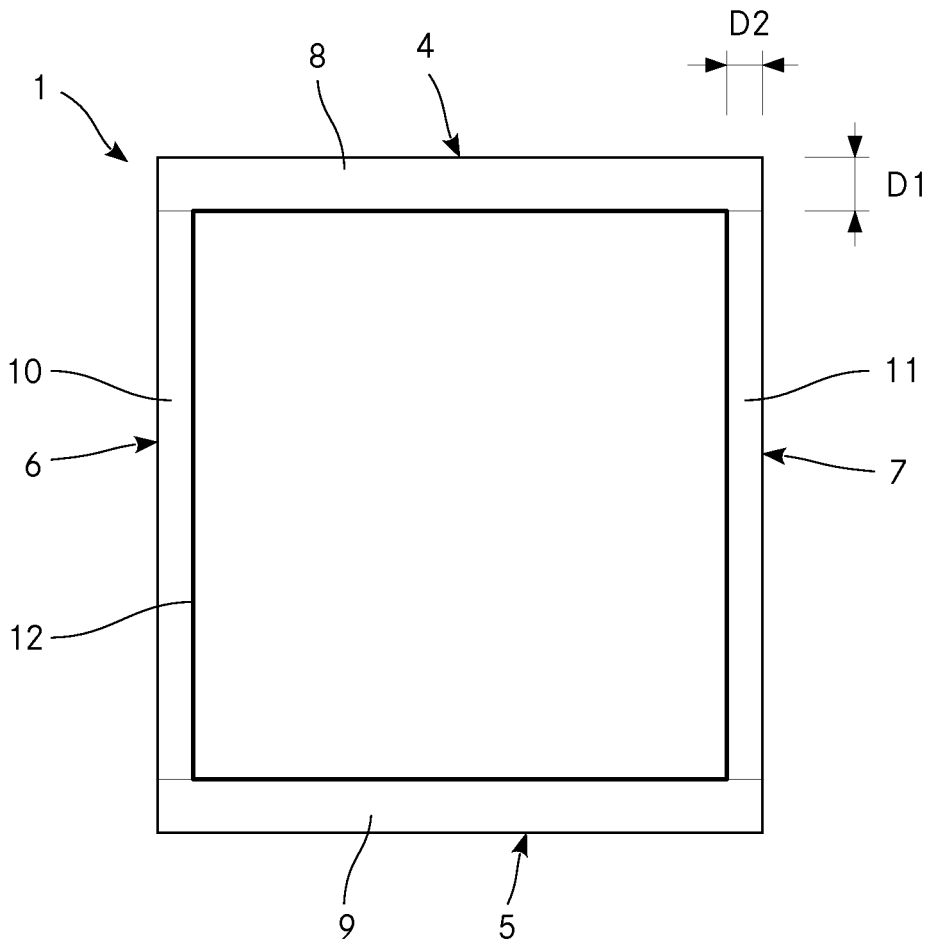
FIG. 1 a schematic illustration of an insulating glass according to the invention.

FIG. 1 shows a schematic illustration of an insulating glass 1 according to the invention. The insulating glass 1 comprises two glass panes, which are held spaced apart from one another by a spacer 12. The spacer 12 is arranged at a first distance D1 in a first region 8 and a second region 9, which adjoin a first edge 4 and respectively an edge 5 lying opposite the first edge 4. In a third region 10 and a fourth region 11, the spacer 12 is arranged at a second distance D2 from a third edge 6 and respectively from a fourth edge 7. The first distance D1 is greater than the second distance D2.

A first adhesive having a rigidity of at least 50 N/mm$^2$ in the cured state is introduced between the two glass panes in the first region 8 and in the second region 9 between the first edge 4 or the second edge 5 and the spacer 12. A second adhesive having a lower rigidity than the first adhesive in the cured state is introduced in the third region 10 and in the fourth region 11 between the third edge 6 or the fourth edge 7 and the spacer 12. The spacer 12 and also the first adhesive or the second adhesive form what is termed the marginal join of the insulating glass 1.

Figure 2A:
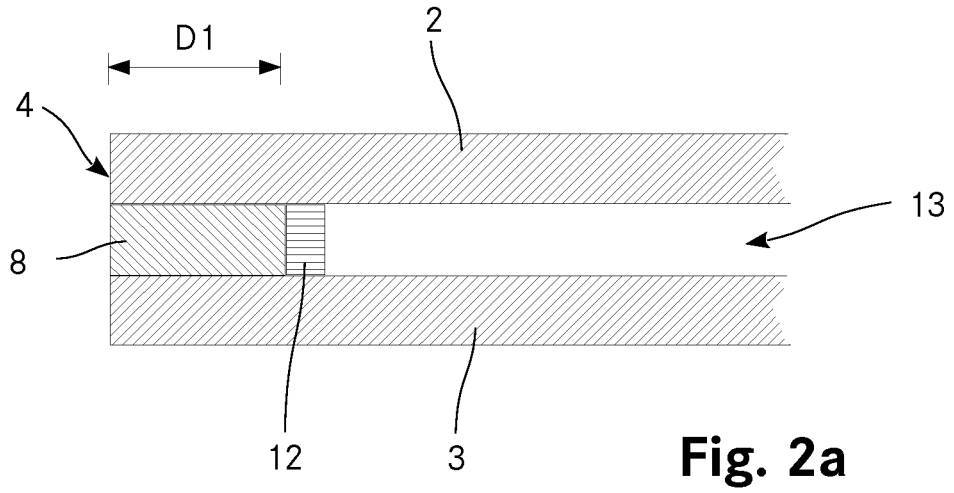
FIGS. 2*a*-2*c* sections of insulating glasses according to the invention in cross section.
Figure 2B:
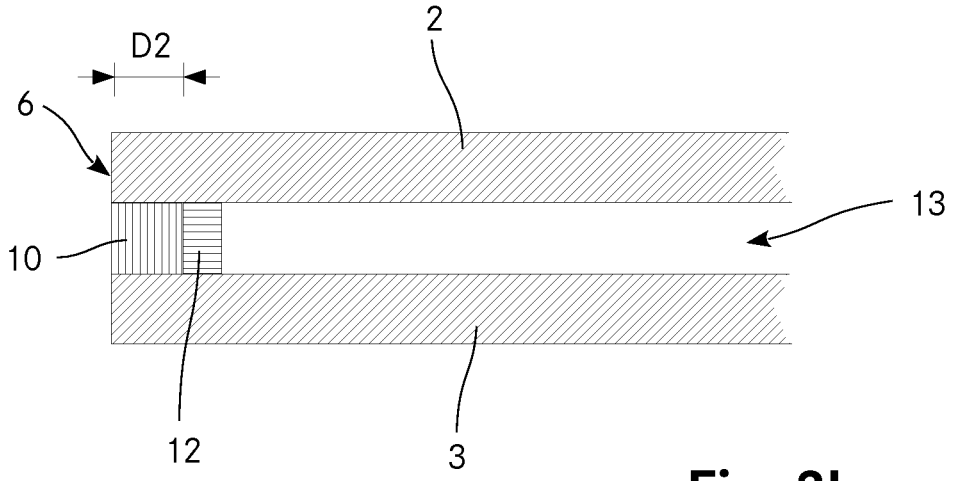
Figure 2C:
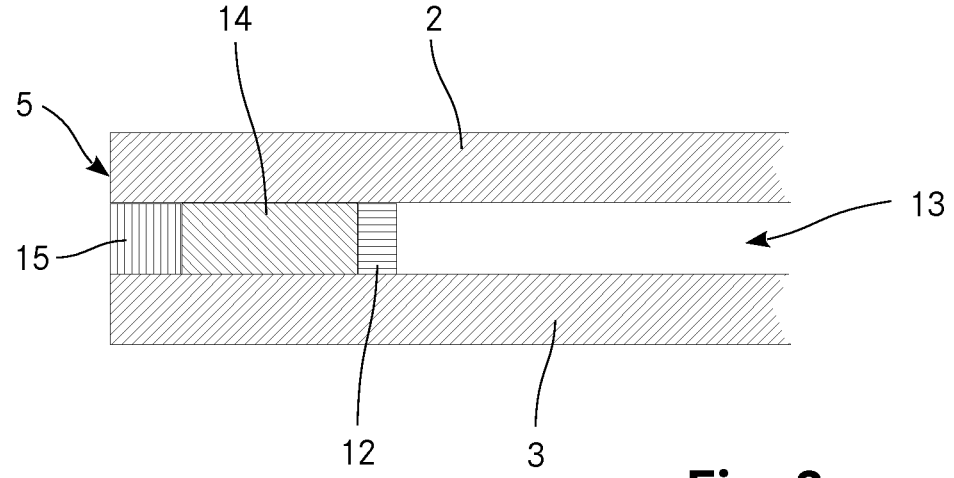

FIGS. 2*a* to 2*c* show sections of insulating glasses according to the invention in cross section. FIG. 2*a* shows a cross section through the first region 8. The spacer 12 is arranged between the first glass pane 2 and the second glass pane 3 at the first distance D1 from the first edge 4. An intermediate space 13, which can be filled for example with an inert gas, is formed in the inner region of the insulating glass as a result of the spacer 12. For reasons of illustration, the spacer 12 is shown in the form of a quadrangle. It ought to be clear to a person skilled in the art, however, that the spacer 12 can be present in any suitable shape. Various shapes and configurations of spacers are known from the prior art. Furthermore, an adhesive and sealant such as polyisobutyl is preferably arranged between the spacer 12 and the glass panes 2, 3, as is known from the prior art. The first adhesive is introduced in the intermediate space between the two glass panes 2, 3 and also the first edge 4 and the spacer 12. A person skilled in the art will understand that the cross section through the second region 9 which adjoins the second edge 5 lying opposite the first edge 4 is identical to the cross section shown here.

FIG. 2*b* shows a cross section through the third region 10. The spacer 12 is arranged between the two glass panes 2, 3 spaced apart from the third edge 6 at a second distance D2. The second adhesive is introduced in the intermediate space between the two glass panes 2, 3 and also the third edge 4 and the spacer 12. A person skilled in the art will understand that the cross section through the fourth region 11 is identical to the cross section shown here.

FIG. 2*c* shows a further embodiment of an insulating glass 1 according to the present invention. In this case, the first adhesive is introduced between the two glass panes 2, 3 between the first edge 5 and the spacer 12 in a first partial region 14. A further adhesive or a sealant is introduced in a second partial region 15. It is thereby possible for the properties of a marginal join to be varied depending on the site of use and the intended use of the insulating glass.

Figure 3:
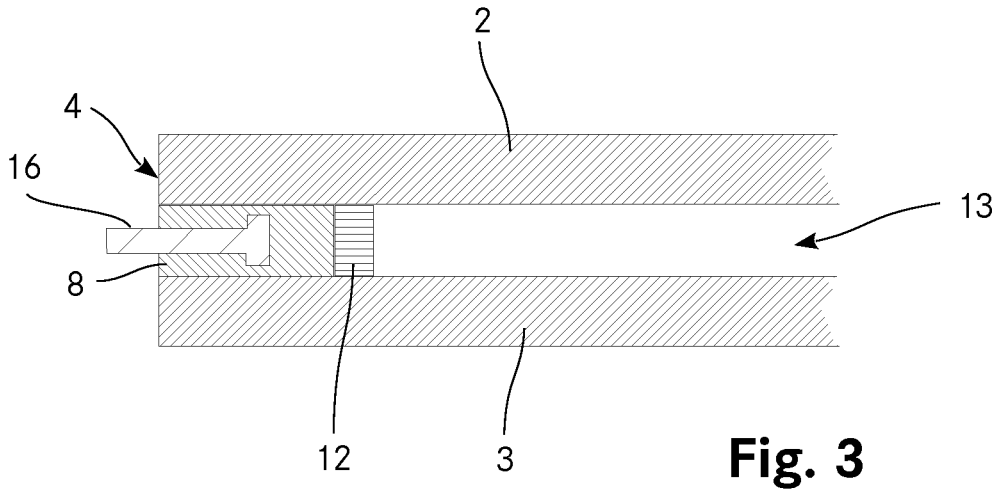
FIG. 3 a section of a further embodiment of an insulating glass according to the invention in cross section.

FIG. 3 shows a section of a further embodiment of an insulating glass 1 in cross section. In the case of this embodiment, an anchoring element 16 is inserted in the second adhesive in the first region 8. The insulating glass 1 can be connected, for example, to further elements via the anchoring element 16.

Figure 4:
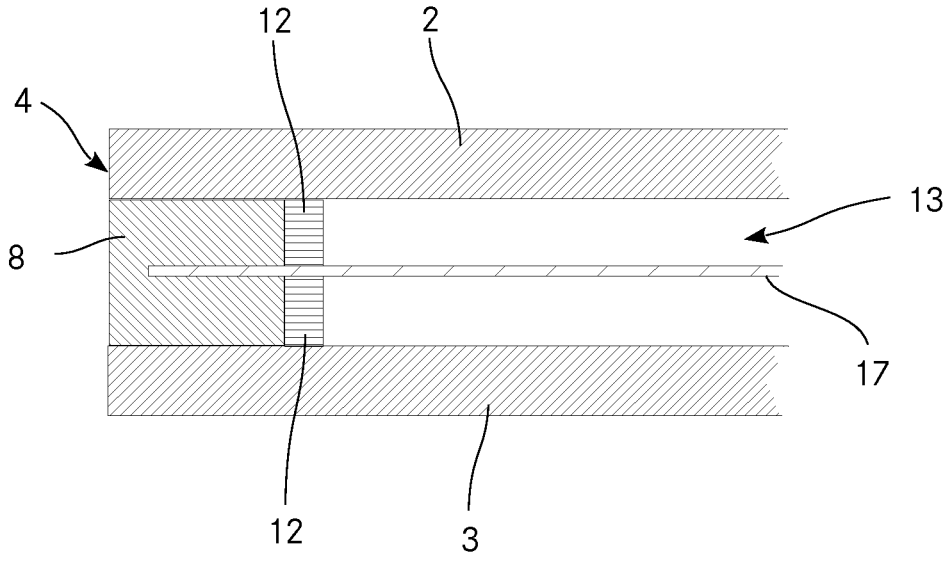
FIG. 4 a further embodiment of an insulating glass according to the invention in cross section.

FIG. 4 shows a further embodiment of an insulating glass 1. In the case of this embodiment, a film 17 is arranged between the two glass panes 2, 3 and is spaced apart from the glass panes 2, 3 by a respective spacer 12. In this case, the film 12 is embedded in the first adhesive. The film 17 forms an additional heat barrier between the two glass panes 2, 3, and this increases the thermal insulation of the insulating glass 1.

The invention claimed is:

1. An insulating glass having at least two glass panes spaced apart from one another, said insulating glass comprising at least one marginal join arranged between the glass panes, said marginal join comprising a spacer and also at least one first adhesive and at least one second adhesive, the marginal join comprising the spacer and only the first adhesive in a first region between a first edge of said insulating glass and the spacer and in a second region between a second edge of said insulating glass and said spacer, said second edge lying opposite of said first edge on said insulating glass, said first adhesive having a rigidity in a cured state of at least 50 N/mm$^2$, wherein the marginal join comprises the spacer and only the second adhesive in a third region between a third edge of said insulating glass and said spacer and in a fourth region between a fourth edge of said insulating glass and said spacer, said third edge and said fourth edge lying opposite to each other on said insulating glass, wherein the second adhesive has a lower rigidity in the cured state than the first adhesive.

2. The insulating glass according to claim 1, wherein the adhesive has a short-term stability with respect to erosion by wind loads of at least 5 N/mm$^2$, preferably of at least 10 N/mm$^2$.

3. The insulating glass according to claim 1, wherein the first adhesive is applied in the first region and the second region to a width of 20 mm to 200 mm from said first and said second edges in a direction of the center of a glass panes.

4. The insulating glass according to claim 1, wherein the marginal join comprises the first adhesive in the regions of the first and second edges in which the insulating glass is supported during an intended use of the insulating glass.

5. The insulating glass according to claim 1, wherein the at least one second adhesive is applied to a smaller width in the third and fourth regions than the first adhesive in the first and second regions.

6. The insulating glass according to claim 1, wherein at least one anchoring element is inserted in the first adhesive in the first or second regions.

7. The insulating glass according to claim 1, wherein a film consisting of a polymer is stretched between the at least two glass panes and parallel thereto, wherein the film is spaced apart from each of the glass panes by way of the at least one spacer.

8. The insulating glass according to claim 1, wherein outermost glass panes of the at least two glass panes consists of a glass laminate.

9. The insulating glass according to claim 1, wherein the first adhesive is applied in the first area of the least two mutually opposite edges to a width of 80 mm to 120 mm from the edge in the direction of the center of the glass panes.

10. The insulating glass according to claim 1, wherein the first adhesive has a rigidity in the cured state of at least 100 N/mm$^2$.

11. A method for producing the insulating glass according to claim 1, said method comprising the following steps:

a) providing a first glass pane of said two glass panes;

b) arranging the at least one spacer circumferentially in the first, second, third and fourth region of the first, second, third and fourth edge, respectively, of the first glass pane at a distance from said edges;

c) applying only the first adhesive, which has a rigidity in a cured state of at least 50 N/mm$^2$, in said first and said second regions, d) applying only the second adhesive, which has a lower rigidity in the cured state than the first adhesive, in said third and said fourth regions, wherein the second glass pane is positioned on the at least one spacer before or after the application of the first adhesive.

* * * * *